US007510292B2

(12) United States Patent
Ichikawa

(10) Patent No.: US 7,510,292 B2
(45) Date of Patent: Mar. 31, 2009

(54) LIQUID CONTAINER

(76) Inventor: Toshimitsu Ichikawa, 2-14-9, Yotsuba, Itabashi-ku, Tokyo (JP) 175-0084

( * ) Notice: Subject to any disclaimer, the term of this patent is extended or adjusted under 35 U.S.C. 154(b) by 0 days.

(21) Appl. No.: 11/948,302

(22) Filed: Nov. 30, 2007

(65) Prior Publication Data

US 2008/0080169 A1 Apr. 3, 2008

Related U.S. Application Data

(62) Division of application No. 11/353,242, filed on Feb. 14, 2006, now Pat. No. 7,311,412.

(30) Foreign Application Priority Data

Feb. 21, 2005 (JP) ..... 2005-043974

(51) Int. Cl.
*F21V 33/00* (2006.01)

(52) U.S. Cl. ..... 362/101

(58) Field of Classification Search ..... 362/101; 215/6, 386

See application file for complete search history.

(56) References Cited

U.S. PATENT DOCUMENTS 5,178,450 A 1/1993 Zelensky et al.
5,504,663 A 4/1996 Tucker
6,322,227 B1 * 11/2001 Liu et al. ..... 362/34
7,040,776 B2 5/2006 Harrell et al.
2003/0063460 A1 4/2003 Nadel
2004/0004829 A1 1/2004 Policappelli

FOREIGN PATENT DOCUMENTS

JP 10245058 A 9/1998
JP 2000168749 A 6/2000
JP 2001097389 A 10/2001

* cited by examiner

*Primary Examiner*—Sandra O'Shea
*Assistant Examiner*—Jason Moon Han
(74) *Attorney, Agent, or Firm*—Westerman, Hattori, Daniels & Adrian, LLP.

(57) ABSTRACT

There are disclosed a cap or lid for a container which has a light emitter that generates zestful reflected light enabling recognition of a content even in a dark place, a container to which a light emitter is attached to generate zestful reflected light, a base member disposed at a bottom of a container and generating zestful reflected light, and a cap or lid disposed at an upper portion of a can-like container and generating zestful reflected light. In a bottle-like container (3) having a translucent main body (4) and accommodating a liquid (W), and a lid, a first cylindrical part (12) is disposed on a top portion (11) of the lid (10) to extend upward, a translucent first horizontal part (14) is attached at a lower end of an inner bore (13) of the first cylindrical part (12), and a second cylindrical part (15) whose upper end is closed is fitted in the inner bore (13) of the first cylindrical part (12), a translucent second horizontal part (18) is attached at a lower end of the second cylindrical part (15), and a light emitter (20) is disposed at an axial center of an inner bore (16) of the second cylindrical part (15).

1 Claim, 10 Drawing Sheets

LIQUID CONTAINER

This application is a divisional of application Ser. No. 11/353,242, filed Feb. 14, 2006.

BACKGROUND OF THE INVENTION

1. Field of the Invention

The present invention relates to an improvement on a bottle-like container that includes a main body for accommodating a liquid such as beverage, and a lid, and also to an improvement on a can-like container that accommodates a liquid.

2. Description of Related Art

Conventionally, a container such as plastic bottle, that accommodates a liquid such as beverage, e.g., juice, is used only to accommodate the liquid as a content, and most of such containers are discarded when the content has been consumed.

Further, the container suffers from an inconvenience that the beverage remaining in the container can not be seen in a dark place such as concert hall or the outdoors at night. The container also suffers from a drawback that when the container or the bottle with some amount of the beverage remaining therein is left with the remaining beverage unrecognized, the remaining beverage may be scattered around and contaminate clothing or the floor or ground.

As conventional techniques related to the container, there are known: an airtight container, as disclosed in JP-A-10-245058 for instance, where a swing stopper is easily attachable and removable to and from a main body; a beverage container with a cap, as disclosed in JP-A-2001-97389 for instance, where a holder for holding the cap as removed from a top end of a main body of the container is disposed at a place on the main body other than the top end; and a method and apparatus for inspecting a barreled beverage, as disclosed in JP-A-2000-168749 for instance.

SUMMARY OF THE INVENTION

This invention is proposed in view of the problems with the conventional techniques as described above, and thus a first object of the invention is to provide a cap or a lid for a container which has a light emitter that generates zestful reflected light that enables recognition of a content of the container even in a dark place. A second object of the invention is to provide a container to which a light emitter is attached to generate zestful reflected light. A third object of the invention is to provide a base member or a bottle holder that is disposed at a bottom of a container to generate zestful reflected light. A fourth object of the invention is to provide a cap or a lid that is disposed at an upper portion of a can-like container to generate zestful reflected light.

Through various studies, the inventor(s) of the invention has found that a light emitting diode (LED) that generates colored light with a small electric power and is attached to a cap or other members can generate zestful reflected light enabling recognition of a remainder of a liquid such as beverage. The invention has been developed based on this finding.

The invention provides a bottle-like container 3 comprising:

a main body 4 formed of a translucent material and containing a liquid W; and a lid 10 having:

a top portion 11;

a first cylindrical part 12 which extends upward from the top portion 11, and inside which an inner bore 13 is defined;

a first horizontal part 14 formed of a translucent material and attached in a lower portion of the inner bore 13 of the first cylindrical part 12;

a second cylindrical part 15 closed at an upper end thereof, which is fitted in the inner bore 13 of the first cylindrical part 12;

a second horizontal part 18 formed of a translucent material and attached at a lower end of the second cylindrical part 15; and a light emitter 20 disposed in an inner bore 16 of the second cylindrical part 15.

The light emitter is preferably a light emitting diode (LED) enabling to select a desired color of the emitted light and use of a battery with a small capacity. However, the light emitter may be constituted by a fluorite or a fluorescent material that does not require a power source.

The second horizontal part may be constituted by a transparent plate, or a light converging or diverging lens, and may be colored.

The invention provides a bottle-like container comprising:

a main body 4 formed of a translucent material and containing a liquid W;

a lid 10A having:

a top portion 11A; and a first horizontal part 14*a* formed of a translucent material and attached to the top portion 11A; and a cylindrical member 15A in a cap-like shape which surrounds the lid 10A and inside which an inner bore 16*a* is defined, the cylindrical member 15A having:

a second horizontal part 18*a* formed of a translucent material and attached in the inner bore 16*a* of the cylindrical member 15A at a vertical position near an axial center of the inner bore 16*a*; and a light emitter 20 disposed between the second horizontal part 18*a* and the top portion 11A of the cylindrical member 15A.

The light emitter is preferably a light emitting diode (LED) enabling to select a desired color of the emitted light and use of a battery with a small capacity. However, the light emitter may be constituted by a fluorite or a fluorescent material that does not require a power source.

The invention provides a bottle-like container comprising:

a main body 4 formed of a translucent material and containing a liquid W; and a lid 10B formed of a translucent material and having:

a top portion 11B;

a cylindrical part 15B which extends upward from the top portion 11B, and inside which an inner bore 13B is defined;

a first horizontal part 14*b* formed of a translucent material and attached in the inner bore 13B of the cylindrical part 15B;

a second horizontal part 17B formed of a translucent material and attached at an upper portion of the inner bore 13B of the cylindrical part 15B;

an annular member 16 formed of a translucent material and attached to the cylindrical part 15B at a vertical position near an axial center of the cylindrical part 15B; and a light emitter 20 disposed in the inner bore 13B of the cylindrical part 15B.

The light emitter is preferably a light emitting diode (LED) enabling to select a desired color of the emitted light and use of a battery with a small capacity. However, the light emitter may be constituted by a fluorite or a fluorescent material that does not require a power source.

The invention provides a bottle-like container comprising:

a main body 4 formed of a translucent material and containing a liquid W; and a lid 10C having:

a top portion 11C;

a cylindrical part 15C closed at an upper end thereof, which is disposed on an upper side of the top portion 11C of the lid 10C;

a light emitter 20 disposed inside the cylindrical part 15*c*; and a cylindrical light bar 22 which is attached to the top portion 11C and inside which an optical fiber and/or an optical visual effect material is disposed to extend downward.

The light emitter is preferably a light emitting diode (LED) enabling to select a desired color of the emitted light and use of a battery with a small capacity. However, the light emitter may be constituted by a fluorite or a fluorescent material that does not require a power source.

The cylindrical light bar in which the optical fiber and/or the optical visual effect material is disposed is preferably constituted by one of a known optical fiber and a known optical visual effect material or both of these. The optical visual effect material may be a known fluorescent material, for instance.

The invention provides a bottle-like container comprising:

a main body 4 formed of a translucent material and containing a liquid W; and a lid 10D having:

a top portion 11D;

a cylindrical part 15D closed at an upper end thereof, and disposed on an upper side of the top portion 11D such that the cylindrical part 15D is eccentric relative to the lid 10D; and a horizontal part 14*d* formed of a translucent material and disposed at a lower end of the cylindrical part 15D;

a light emitter 20 disposed inside the cylindrical part 15D; and a drinking straw S removably attached to the top portion 11D of the lid 10D.

The cylindrical part is eccentric relative to the lid in a degree such that the cylindrical part does not interfere with attachment of the drinking straw S.

The light emitter is preferably a light emitting diode (LED) enabling to select a desired color of the emitted light and use of a battery with a small capacity. However, the light emitter may be constituted by a fluorite or a fluorescent material that does not require a power source.

The invention provides a bottle-like container comprising:

a main body 4A which is formed of a translucent material, contains a liquid W, and has a cylindrical part 4Aa, a sticker M having a property of reflecting light being attached at an appropriate position in the cylindrical part 4Aa;

a lid 10E having:

a first bore 11*a* having, at an end portion on an open side thereof, an internal thread to engage with the main body 4A;

a second bore 11*b* having a diameter smaller than that of the first bore 11*a* and formed at an end portion of the first bore 11*a* on a closed side thereof opposite to the open side;

a light emitter 20 disposed in the second bore 11*b*; and a horizontal part 11*e* formed of a translucent material which is attached at an open end portion of the second bore 11*b*; and a saucer-like base member 25 which is removably attached to an under side of the main body 4A, and has a bottom surface 26 including a light reflecting surface having a property of reflecting light.

The light emitter is preferably a light emitting diode (LED) enabling to select a desired color of the emitted light and use of a battery with a small capacity. However, the light emitter may be constituted by a fluorite or a fluorescent material that does not require a power source.

The light reflecting surface in the bottom surface of the base member 25 may be a mirror surface or a fluorescent surface.

The invention provides a bottle-like container comprising:

a main body 4A formed of a translucent material and containing a liquid W, the main body 4A having a bottom portion in which a first horizontal part 31 formed of a translucent material having a translucency higher than that of the main body 4A is disposed;

a lid 10F having:

a top portion 11F; and a drinking straw Sf which is removably attached to the top portion 11F, and in which an optical fiber is inserted; and a saucer-like base member 25A removably attached to an under side of the main body 4A, and having:

a bottom portion in which a recess 27 is formed at a position corresponding to the first horizontal part 31;

a second horizontal part 28 having a translucency equal to that of the first horizontal part 31 and disposed in an upper end portion of the recess 27; and a light emitter 20 disposed in the recess 27.

The light emitter is preferably a light emitting diode (LED) enabling to select a desired color of the emitted light and use of a battery with a small capacity. However, the light emitter may be constituted by a fluorite or a fluorescent material that does not require a power source.

The invention provides a bottle-like container comprising:

a main body 4B formed of a translucent material and containing a liquid W in which a light reflecting material Rw not harmful to human being and animals and having a property of reflecting light is mixed, a cylindrical body 28 formed of a translucent material being attached inside the main body 4B to extend perpendicularly to an axis of the main body 4B;

a lid 1 formed of a translucent material; and a cylindrical member 31 closed at an end thereof and attached to an end 28*e* of the cylindrical body 28, the cylindrical member 31 having:

a light emitter 20 being disposed in the inner bore 32 of the cylindrical member 31; and a polarizing plate 34 having a polarizing property and disposed inside the cylindrical member 31 on the side of the cylindrical body 28.

The light emitter is preferably a light emitting diode (LED) enabling to select a desired color of the emitted light and use of a battery with a small capacity. However, the light emitter may be constituted by a fluorite or a fluorescent material that does not require a power source.

The invention provides a bottle-like container comprising:

a main body 4C formed of a translucent material and containing a liquid W; and a lid 10G having:

a top portion 11G;

a cylindrical part 15G extending upward from the top portion 11G;

a horizontal part 14*g* formed of a translucent material and disposed in a lower portion of an inner bore 13G of the cylindrical part 15G;

a light emitter 20 disposed in the inner bore 13G;

a drinking straw S extending from the exterior of the cylindrical part 15G to the inside of the main body 4C through the horizontal part 14*g*; and a donut-shaped float 45 in which the drinking straw S is loosely fitted.

The invention provides a can-like container comprising:

a main body 44 containing a liquid W; and a lid 50 removably attached to an upper portion of the main body 44 and having:

a horizontal part 61 formed of a translucent material;

a first bore 52*a* formed in a lower portion of the lid 50 and having an internal diameter conforming to an external diameter of the upper portion of the main body 44;

a second bore 52*b* connected to an end of the first bore 52*a* and having a diameter smaller than that of the first bore 52*a;* a third bore 56 connected to an end of the second bore 52*b* via the horizontal part 61 such that transmission of light across the horizontal part 61 is allowed, the third bore 56 having a diameter smaller than that of the second bore 52*b;* a light emitter 20 disposed in the third bore 56;

a plate 58 on which an image 58*a* is painted with a fluorescent paint, and which is attached in the first bore 52*a*; and a drinking straw S extending from the exterior of the lid 50 to the inside of the main body 44 through the second bore 52*b*, the first bore 52*a*, and the plate 58.

The light emitter is preferably a light emitting diode (LED) enabling to select a desired color of the emitted light and use of a battery with a small capacity. However, the light emitter may be constituted by a fluorite or a fluorescent material that does not require a power source.

The desired image painted with the fluorescent paint on the plate may be a mark of a character, a name of an owner of the container, or others.

There will be enumerated effects of the invention.

(1) Since the light emitter is attached to the lid, the light from the light emitter is radiated in the main body of the container to be reflected by the surface of the liquid such as juice, thereby enabling easy recognition of an amount of the remaining liquid even in a dark place.

(2) By employing an LED as the light emitter, a button battery or the like can be used and zestful reflected light can be radiated in any desired color to the exterior of the container. By employing the LED and button battery, the LED and button battery require only a small space for attachment, and the cost is reduced.

(3) By employing the fluorite, fluorescent material, or the like as the light emitter, a power source can be omitted.

(4) By employing the lens that converges or diverges light as the translucent plate, a direction of the reflected light can be determined as desired. Further, where the lens is colored, a color synthesis with the light of the LED is enabled, thereby making it possible to have the reflected light in any desired color.

(5) When the container becomes empty, the lid can be reused by removing the lid from the empty main body and attaching the lid to a main body of another container.

(6) By pouring water into the main body of the container when the container becomes empty, the container can be used as an accessory.

(7) By removably attaching the drinking straw to the lid, the direction and others of the reflected light changes as the liquid such as beverage is sucked through the straw, thereby giving a zest.

(8) By attaching to the lid the cylindrical light bar in which the optical fiber and/or the optical visual effect material is disposed, and which extends downward, a range of radiation of the light is expanded, thereby enabling light reflection in various tones in various ways.

(9) By attaching the drinking straw in which the optical fiber is inserted and which is attached to the lid, the reflected light is radiated from the upper portion of the straw, thereby rendering the straw zestful and enabling easy recognition of the presence or location of the straw even in a dark place.

(10) The sticker as attached to the main body of the container and having a property of reflecting light cooperates with the change of the liquid surface to increase a variation in the light reflection.

(11) By disposing the saucer-like base member under the main body of the container, and putting on the bottom surface of the base member the image of the character, the name of a person, or others, having a property of reflecting light, the container becomes a unique accessory, and a mistake to drink juice or other kinds of beverage of another can be prevented.

(12) By disposing the saucer-like base member under the main body of the container, and attaching a light emitter to the base member, the light emitted from the under side of the main body of the container enters the main body, giving a distinct flavor.

(13) By mixing a harmful material having a property of reflecting light, which may be particles of gold, in the liquid accommodated in the main body of the container, and attaching the cylindrical body formed of a translucent material to extend in a lateral direction or the direction perpendicular to the axis of the main body so that the light from the light emitter is radiated into the cylindrical body, the light travels along the extending direction of the cylindrical body and is also reflected by the harmful reflecting material in the liquid to produce light rays in random directions, thereby giving a flavor.

(14) By floating the float having a property of reflecting light on the liquid accommodated in the main body of the container, the float produces zestful reflected light along with the reflected light from the liquid surface.

(15) By removably attaching the lid formed of a translucent material to the upper portion of the main body of the can-like container, and making the light emitter in the upper portion of the lid to emit light toward the plate having the fluorescent paint thereon and attached below the lid, reflected light can be radiated to the exterior of the container through the lid, even where the container is a can-like container formed of an opaque material.

DETAILED DESCRIPTION OF THE PREFERRED EMBODIMENTS

Hereinafter, there will be described embodiments of the invention, by referring to the accompanying drawings.

Figure 1:
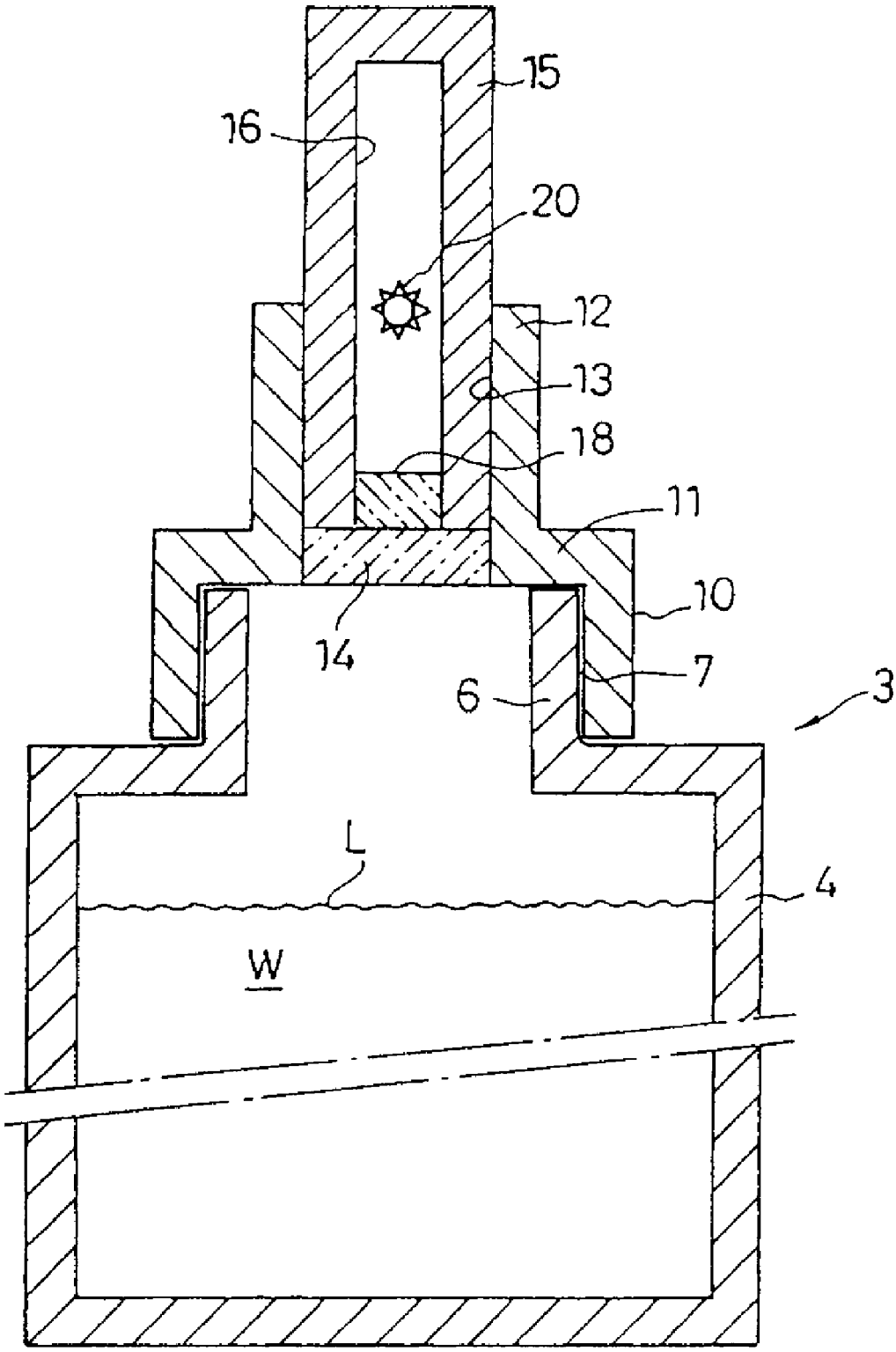
FIG. 1 is a cross-sectional view of an overall structure of a bottle-like container according to a first embodiment of the invention.

FIG. 1 is a cross-sectional view of an overall structure of a bottle-like container according to a first embodiment of the invention, as improved over the conventional containers.

A container 3 according to the first embodiment includes a bottle-like main body 4 which is formed of a translucent material and in which a liquid beverage W such as juice is accommodated, a neck portion 6 formed on an upper side of the main body 4, and a lid 10. As shown in FIG. 1, the lid 10 is fastened to the neck portion 6 by being screwed on an external thread 7 formed on the neck portion 6. The fastening may not be made by the screwing, but may be made by fitting.

The lid 10 includes a top portion 11 that corresponds to an upper end in a usual lid and a first cylindrical part 12 extending upward from the top portion 11. At a lower end portion of an inner bore 13 of the first cylindrical part 12, there is attached a first horizontal part 14 formed of a translucent material. The first horizontal part 14 may be constituted by a light converging lens or a light diverging lens, and preferably matches with the color of the main body 4 or the liquid W.

A second cylindrical part 15 which is closed at its upper end is fitted slightly tightly in the bore 13 of the first cylindrical part 12 and extends to upward to protrude from the first cylindrical part 12 with a bottom of the second cylindrical part 15 located near the first horizontal part 14. The second cylindrical part 15 is formed of a translucent material that may be fluorescent or opaque.

A second horizontal part 18 is attached at a lower end of an inner bore 16 of the second cylindrical part 15, to be located near the first horizontal part 14. The second horizontal part 18 may be constituted by a light converging lens or a light diverging lens.

A light emitter 20 is disposed near a radial and an axial center of the inner bore 16.

The light emitter 20 is preferably a light emitting diode, from which two conducting wires extend to be connected to a button battery fixed on a wall defining the inner bore 16, although not shown. The color of the light emitted from the light emitter 20 may be any, but preferably matches the main body 4 and the first and second horizontal parts 14, 18.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

An operation of the thus constructed bottle-like container 3 will be described, with reference to FIG. 1.

With the main body 4 accommodating the liquid W such as juice to a liquid level L, the light emitter 20 as disposed in the inner bore 16 of the second cylindrical part 15 emits light. A part of the light is transmitted through the second cylindrical part 15 and radiated upward to the exterior, while the rest of the light is transmitted through the second and first horizontal parts 18, 14 to enter the main body 4.

The part of the light entering the main body 4 is reflected by the liquid surface L and radiated to the exterior of the main body 4, thereby enabling to recognize the liquid level L from the exterior. In particular, in a place dim or dark, the liquid level is easily recognizable. By turning the container 3 to incline the liquid surface, the reflected light is displaced to make recognition of the liquid level further easy.

Where the second cylindrical part 15 is fluorescent, the light emitted from the light emitter 20 is radiated in a fluorescent color upward to the exterior, thereby enabling overall recognition of the container 3. On the other hand, where the second cylindrical part 15 is opaque, the light from the light emitter 20 is radiated to the exterior of the main body 4, to be used only to recognize an amount of the liquid remaining in the container 3.

When the main body 4 becomes empty with all the liquid W having been consumed, the lid 10 is removed and attached to another main body 3 to be reused and operate in the same way as described above.

Where the light emitter 20 is not a light emitting diode requiring a power source, but is constituted by a fluorite or a fluorescent member, the color of the emitted light is limited to fluorescent colors, but the light emitter 20 of the fluorite or fluorescent member can emit light in the darkness by receiving invisible light such as infrared light.

Figure 2:
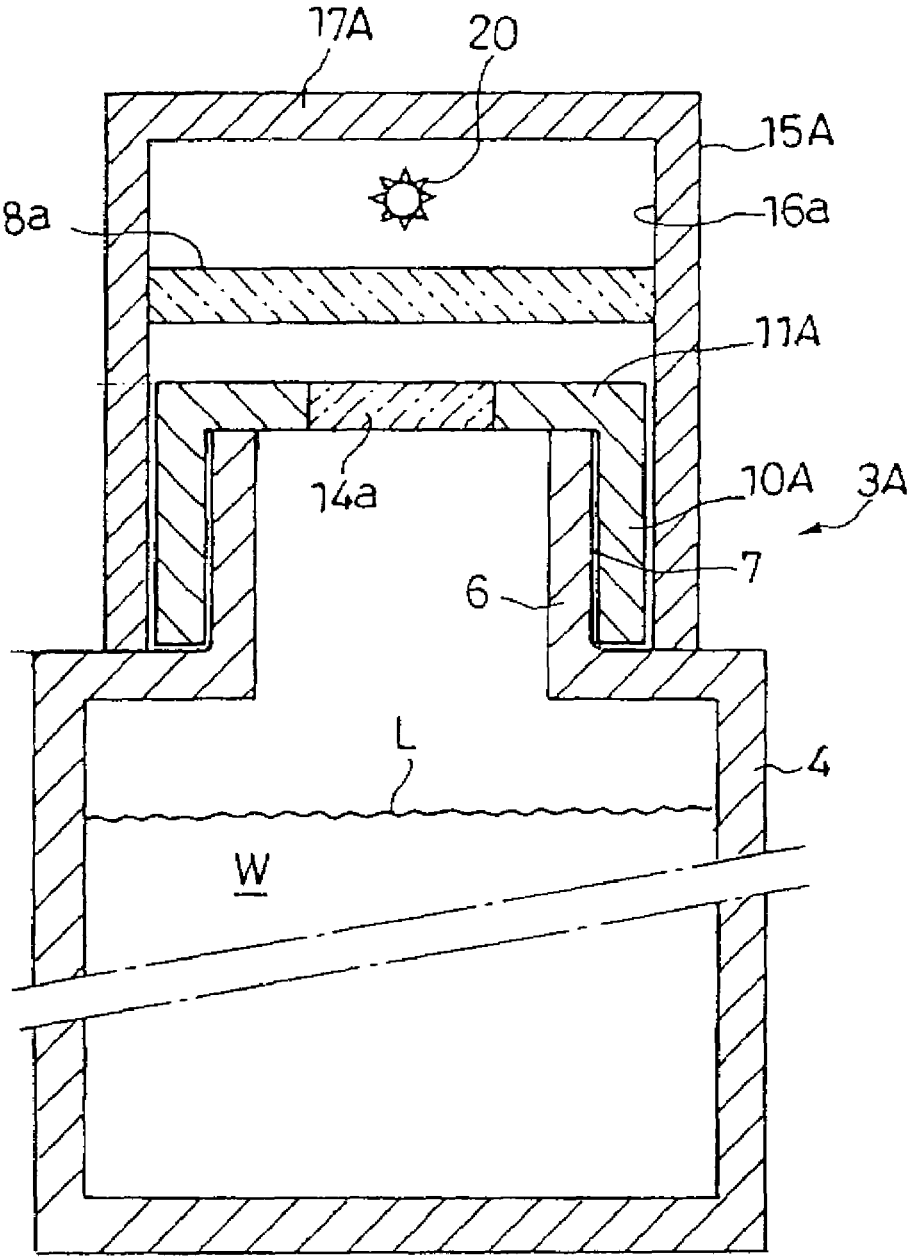
FIG. 2 is a cross-sectional view of an overall structure of a bottle-like container according to a second embodiment of the invention.

FIG. 2 is a cross-sectional view of an overall structure of a bottle-like container according to a second embodiment of the invention, as improved over the conventional containers.

A container 3A according to the second embodiment includes a bottle-like main body 4 which is formed of a translucent material and in which a liquid beverage W such as juice is accommodated, a neck portion 6 formed on an upper side of the main body 4, and a lid 10A. As shown in FIG. 2, the lid 10A is fastened to the neck portion 6 by being screwed on an external thread 7 formed on the neck portion 6. The fastening may not be made by the screwing, but may be made by fitting.

To the lid 10A has a top portion 11A that corresponds to an upper end in a usual lid. A first horizontal part 14*a* formed of a translucent material is disposed in the top portion 11A.

The first horizontal part 14*a* may be constituted by a light converging lens or a light diverging lens, and preferably matches with the color of the main body 4 or the liquid W.

A cylindrical member 15A in a cap-like shape is disposed around the lid 10A with a clearance therebetween so as to facilitate attachment and removal of the cylindrical member 15A to and from the lid 10A. A second horizontal part 18*a* formed of a translucent material is attached in an inner bore 16*a* of the cylindrical member 15A, at a position near a radial and an axial center of the inner bore 16*a*, with a suitable spacing between the second horizontal part 18*a* and the top portion 11A.

The first horizontal part 18*a* may be constituted by a light converging lens or a light diverging lens.

A light emitter 20 is disposed between the second horizontal part 18*a* attached in the inner bore 16*a* of the cylindrical member 15A and the top portion 17A of the cylindrical member 15A.

The light emitter 20 is preferably a light emitting diode, from which two conducting wires extend to be connected to a button battery fixed on a wall defining the inner bore 16*a*, although not shown. The color of the light emitted from the light emitter 20 may be any, but preferably matches the main body 4 and the first and second horizontal parts 14*a*, 18*a*.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

An operation of the thus constructed bottle-like container 3A will be described, with reference to FIG. 2.

With the main body 4 accommodating the liquid W such as juice to a liquid level L, the light emitter 20 as disposed in the inner bore 16*a* of the cylindrical member ISA emits light. The emitted light is transmitted through the second and first horizontal parts 18*a*, 14*a* to enter the main body 4.

The part of the light entering the main body 4 is reflected by the liquid surface L and radiated to the exterior of the main body 4, thereby enabling to recognize the liquid level L from the exterior. In particular, in a place dim or dark, the liquid level is easily recognizable. By turning the container 3A to incline the liquid surface, the reflected light is displaced to make recognition of the liquid level further easy.

When the main body 4 becomes empty with all the liquid W having been consumed, the lid 10A is removed and attached to another main body to be reused and operate in the same way as described above.

Where the light emitter 20 is not a light emitting diode requiring a power source, but is constituted by a fluorite or a fluorescent member, the color of the emitted light is limited to fluorescent colors, but the light emitter 20 of the fluorite or fluorescent member can emit light in the darkness by receiving invisible light such as infrared light.

Figure 3:
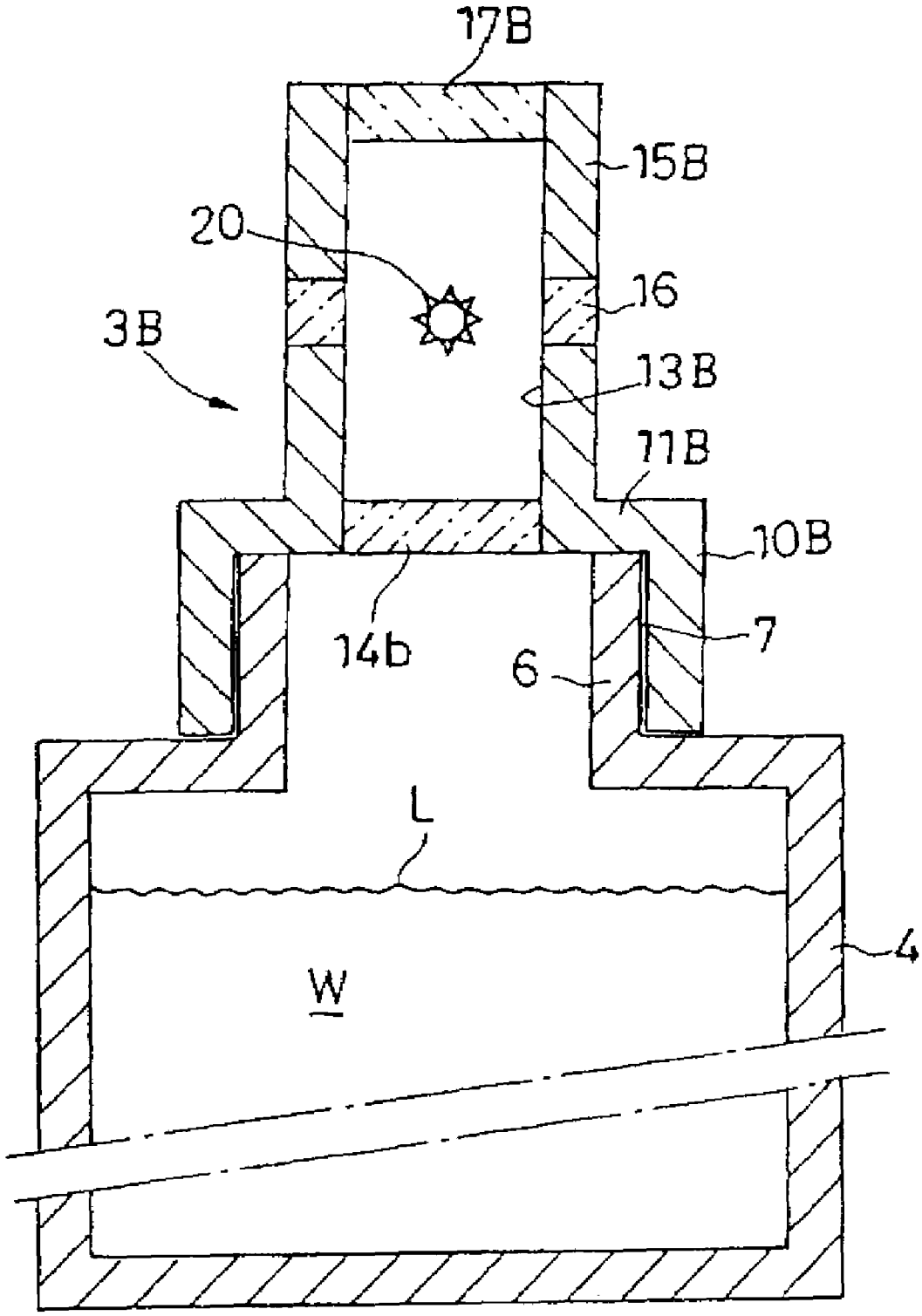
FIG. 3 is a cross-sectional view of an overall structure of a bottle-like container according to a third embodiment of the invention.

FIG. 3 is a cross-sectional view of an overall structure of a bottle-like container according to a third embodiment of the invention, as improved over the conventional containers.

A container 3B according to the first embodiment includes a bottle-like main body 4 which is formed of a translucent material and in which a liquid beverage W such as juice is accommodated, a neck portion 6 formed on an upper side of the main body 4, and a lid 10B. As shown in FIG. 3, the lid 10B is fastened to the neck portion 6 by being screwed on an external thread 7 formed on the neck portion 6. The fastening may not be made by the screwing, but may be made by fitting.

The lid 10B is formed of a translucent material, and includes a top portion 11B that corresponds to an upper end in a usual lid, and a cylindrical part 15B extending upward from the top portion 11B.

At a lower end of an inner bore 13B of the cylindrical part 15B and at a vertical position substantially the same as the top portion 11B, there is attached a first horizontal part 14*b* formed of a translucent material.

The first horizontal part 14*b* may be constituted by a light converging lens or a light diverging lens, and preferably matches with the color of the main body 4 or the liquid W.

A second horizontal part 17B formed of a translucent material is attached at an upper end of the inner bore 13B of the cylindrical part 15B. A light emitter 20 is disposed near a radial and an axial center of the inner bore 13B.

An annular member 16 formed of a translucent material is attached to the cylindrical part 15B at a vertical position near an axial center of the cylindrical part 15B and substantially the same as that of the light emitter 20.

The light emitter 20 is preferably a light emitting diode, from which two conducting wires extend to be connected to a button battery fixed on a wall defining the inner bore 13B, although not shown. The color of the light emitted from the light emitter 20 may be any, but preferably matches the main body 4 and the first and second horizontal parts 14*b*, 17B.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

An operation of the thus constructed bottle-like container 3B will be described, with reference to FIG. 3.

With the main body 4 accommodating the liquid W such as juice to a liquid level L, the light emitter 20 as disposed in the inner bore 13B of the cylindrical part 15B emits light. A part of the light is transmitted through the second horizontal part 17B and radiated upward to the exterior, another part of the light is transmitted through the translucent annular member 16 and horizontally radiated to the exterior, and the rest of the light is transmitted through the first horizontal part 14*b* to enter the main body 4.

The part of the light entering the main body 4 is reflected by the liquid surface L and radiated to the exterior of the main body 4, thereby enabling to recognize the liquid level L from the exterior. In particular, in a place dim or dark, the liquid level is easily recognizable. By turning the container 3B to incline the liquid surface, the reflected light is displaced to make recognition of the liquid level further easy.

Thus, the light emitted from the light emitter 20 not only enables recognition of an amount of the remaining liquid, but also gives a function of an accessory of light to the container 3B.

When the main body 4 becomes empty with all the liquid W having been consumed, the lid 10B is removed and attached to another main body to be reused and operate in the same way as described above.

Where the light emitter 20 is not a light emitting diode requiring a power source, but is constituted by a fluorite or a fluorescent member, the color of the emitted light is limited to fluorescent colors, but the light emitter 20 of the fluorite or fluorescent member can emit light in the darkness by receiving invisible light such as infrared light.

Figure 4:
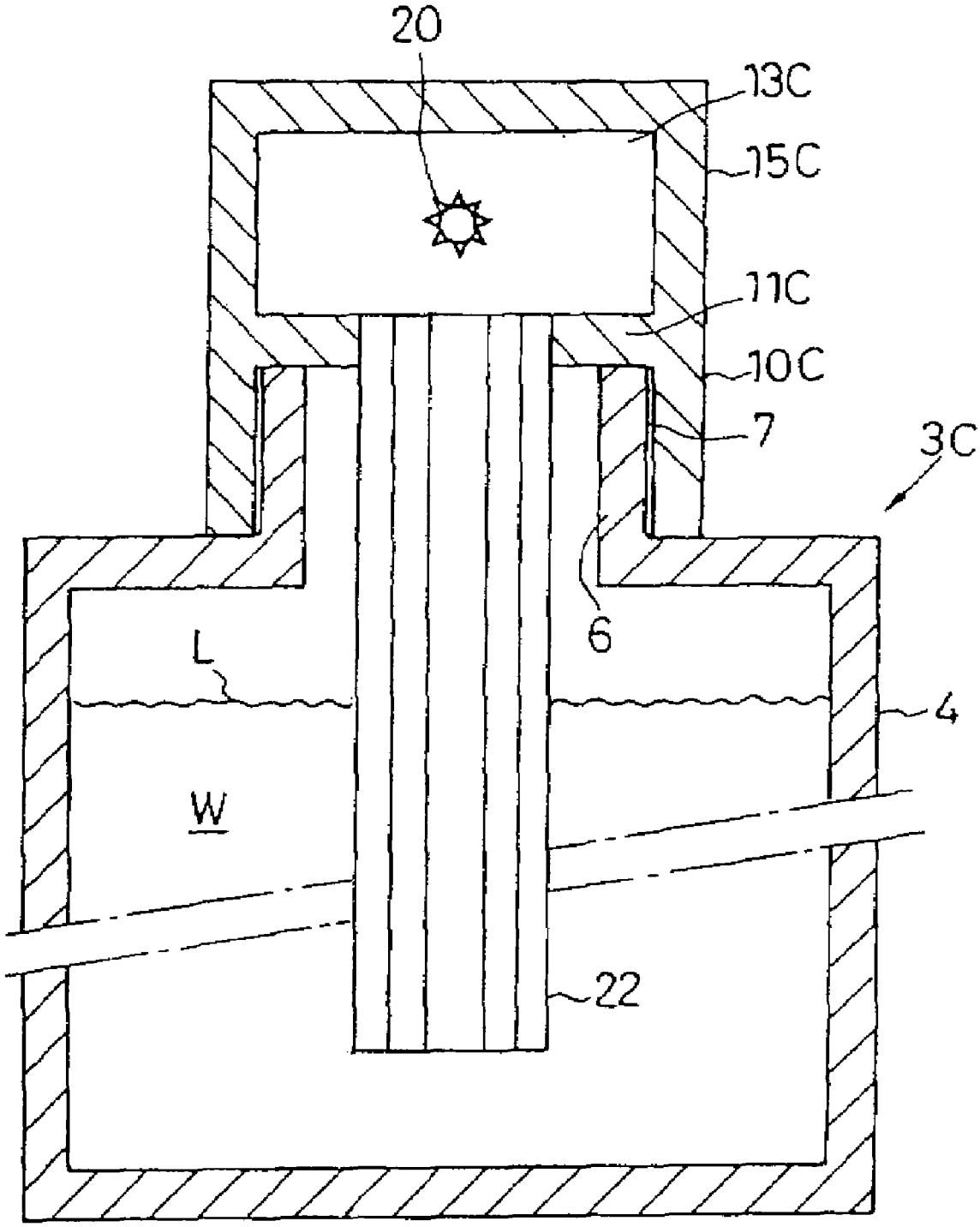
FIG. 4 is a cross-sectional view of an overall structure of a bottle-like container according to a fourth embodiment of the invention.

FIG. 4 is a cross-sectional view of an overall structure of a bottle-like container according to a fourth embodiment of the invention, as improved over the conventional containers.

A container 3C according to the fourth embodiment includes a bottle-like main body 4 which is formed of a translucent material and in which a liquid beverage W such as juice is accommodated, a neck portion 6 formed on an upper side of the main body 4, and a lid 10C. As shown in FIG. 4, the lid 10C is fastened to the neck portion 6 by being screwed on an external thread 7 formed on the neck portion 6. The fastening may not be made by the screwing, but may be made by fitting.

The lid 10C has a top portion 11C that corresponds to an upper end in a usual lid, and a cylindrical part 15C closed at its upper end is disposed on an upper side of the top portion 11C. A cylindrical light bar 22 is attached to the top portion 11C to extend downward. A known optical fiber and/or an optical visual effect material such as fluorite or fluorescent material is disposed inside the light bar 22.

A light emitter 20 is disposed near a radial and an axial center of the inner bore 13C.

The light emitter 20 is preferably a light emitting diode, from which two conducting wires extend to be connected to a button battery fixed on a wall defining the inner bore 13C, although not shown. The color of the light emitted from the light emitter 20 may be any, but preferably matches the main body 4 and the light bar 22.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

An operation of the thus constructed bottle-like container 3C will be described, with reference to FIG. 4.

With the main body 4 accommodating the liquid W such as juice to a liquid level L, the light emitter 20 as disposed in the inner bore 13C of the cylindrical part 15C emits light that enters the light bar 22. From the inside of the light bar 22, the light is transmitted through a cylindrical wall of the light bar 22 to be radiated around the light bar 22 in the main body 4.

The light from the light bar 22 is radiated to the exterior of the main body 4. The color density of the radiated light is different between a place above the liquid surface L, and a place below the liquid surface, thereby enabling recognition of the liquid level L from the exterior. In particular, in a place dim or dark, the liquid level is easily recognizable. By turning the container 3C to incline the liquid surface L, the reflected light is displaced to make recognition of the liquid level further easy.

The light emitted from the light emitter 20 not only enables recognition of an amount of the remaining liquid, but also gives a function of an accessory of light to the container 3C.

When the main body 4 becomes empty with all the liquid W having been consumed, the lid 10C is removed and attached to another main body 4 to be reused and operate in the same way as described above.

Where the light emitter 20 is not a light emitting diode requiring a power source, but is constituted by a fluorite or a fluorescent member, the color of the emitted light is limited to fluorescent colors, but the light emitter 20 of the fluorite or fluorescent member can emit light in the darkness by receiving invisible light such as infrared light.

Figure 5:
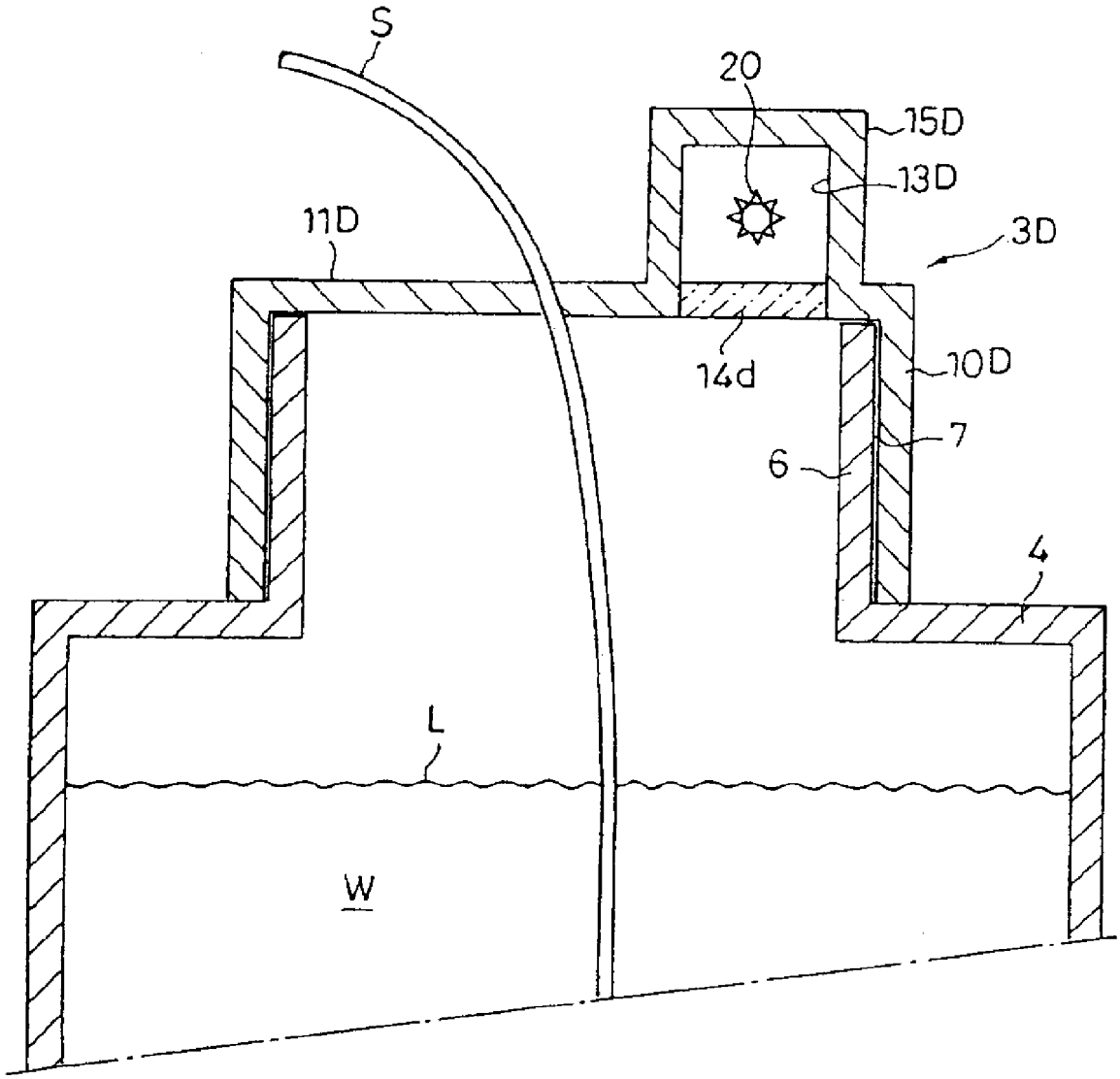
FIG. 5 is a cross-sectional view of an overall structure of a bottle-like container according to a fifth embodiment of the invention.

FIG. 5 is a cross-sectional view of an overall structure and an operation of a bottle-like container according to a fifth embodiment of the invention, as improved over the conventional containers.

A container 3D according to the fifth embodiment includes a bottle-like main body 4 which is formed of a translucent material and in which a liquid beverage W such as juice is accommodated, a neck portion 6 formed on an upper side of the main body 4, and a lid 10D. As shown in FIG. 5, the lid 10D is fastened to the neck portion 6 by being screwed on an external thread 7 formed on the neck portion 6. The fastening may not be made by the screwing, but may be made by fitting.

The lid 10D includes a top portion 11D that corresponds to an upper end in a usual lid, and a cylindrical part 15D that extends upward from a portion of the top portion 11D which is deviated from an axis of lid 10D.

At a lower end of an inner bore 13D of the cylindrical part 15D and at a vertical position substantially the same as the top portion 11D, there is attached a horizontal part 14*d* formed of a translucent material. A light emitter 20 is disposed near a radial and an axial center of the cylindrical part 15D.

The light emitter 20 is preferably a light emitting diode, from which two conducting wires extend to be connected to a button battery fixed on a wall defining the inner bore 13D, although not shown. The color of the light emitted from the light emitter 20 may be any, but preferably matches the main body 4 and the horizontal part 14*d*.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

The horizontal part 14*d* may be constituted by a light converging lens or a light diverging lens, and preferably matches with the color of the main body 4 or the liquid W.

A drinking straw S is removably attached to the top portion 11D.

An operation of the thus constructed bottle-like container 3D will be described, with reference to FIG. 5.

With the main body 4 accommodating the liquid W such as juice to a liquid level L, the light emitter 20 as disposed in the inner bore 13D of the cylindrical part 15D emits light. The light is transmitted through the horizontal part 14*d* to enter the main body 4.

The light having entered the main body 4 is reflected by the liquid surface L, that changes when the liquid W is sucked through the straw S. Reflected light from the liquid surface as lowering is radiated to the exterior of the main body 4 to enable recognition of the liquid level L lowering from the exterior. In particular, in a place dim or dark, the liquid level L is easily recognizable. By turning the container 3D to incline the liquid surface, the reflected light is displaced to make recognition of the liquid level L further easy.

Thus, the light emitted from the light emitter 20 not only enables recognition of an amount of the remaining liquid, but also gives a function of an accessory of light to the container 3D by the light reflected at the liquid surface whose level changes when the liquid W is sucked through the straw S.

When the main body 4 becomes empty with all the liquid W having been consumed, the lid 10D is removed and attached to another main body 4 to be reused and operate in the same way as described above.

Where the light emitter 20 is not a light emitting diode requiring a power source, but is constituted by a fluorite or a fluorescent member, the color of the emitted light is limited to fluorescent colors, but the light emitter 20 of the fluorite or fluorescent member can emit light in the darkness by receiving invisible light such as infrared light.

Figure 6:
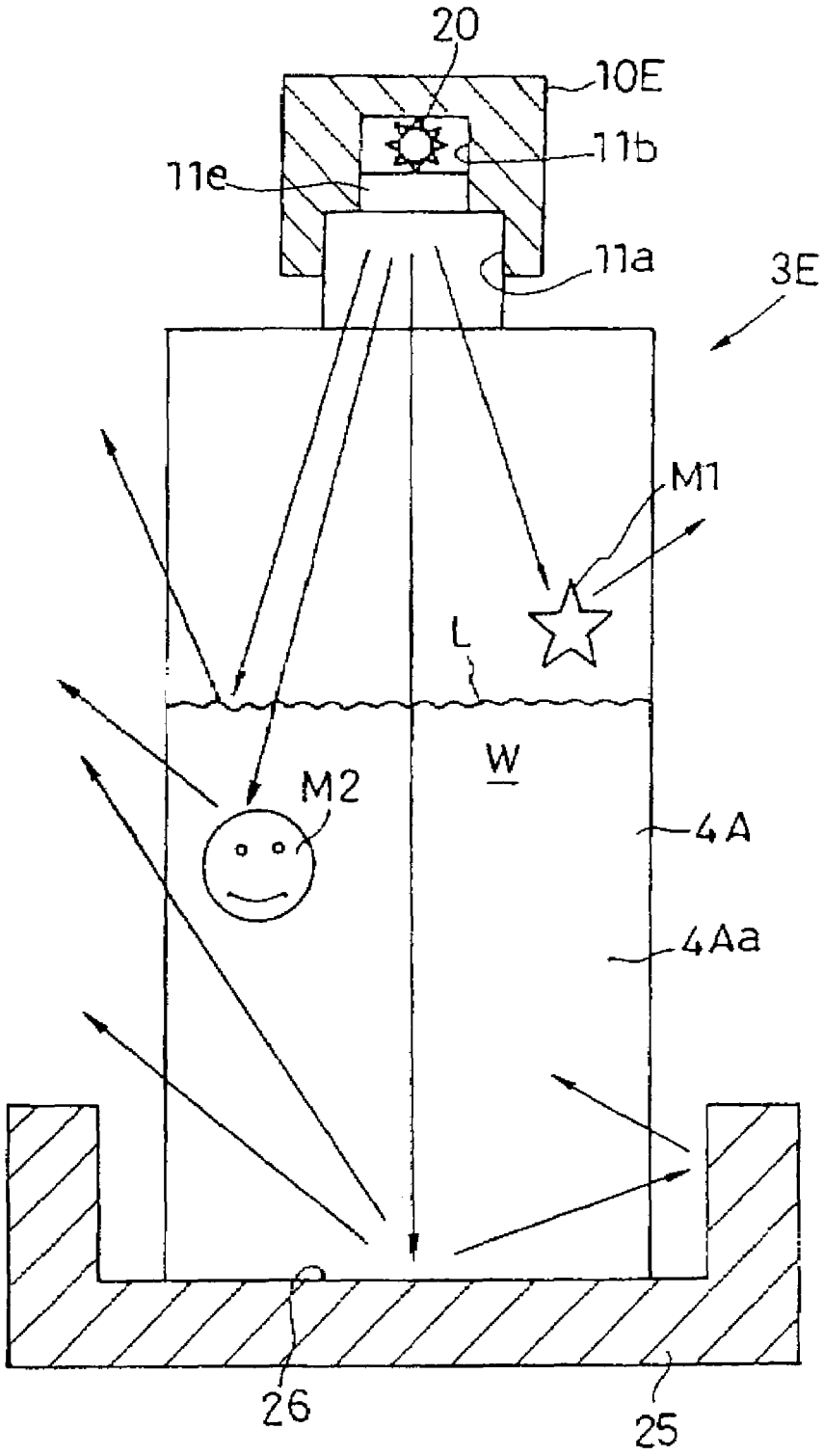
FIG. 6 is a cross-sectional view of an overall structure and an operation of a bottle-like container according to a sixth embodiment of the invention.

FIG. 6 is a cross-sectional view of an overall structure and an operation of a bottle-like container according to a sixth embodiment of the invention, as improved over the conventional containers.

A container 3E according to the sixth embodiment includes a bottle-like main body 4A which is formed of a translucent material and in which a liquid beverage W such as juice is accommodated, and a lid 10E that is fastened to an upper portion of the main body 4A by being screwed thereon. The fastening may not be made by the screwing, but may be made by fitting.

The lid 10E has at its open side a first bore 11*a* having an internal thread to engage with an upper part of the main body 4A which has a diameter smaller than that of the cylindrical part 4Aa. From a side of the first bore 11*a* opposite to the open side, a second bore 11*b* having a diameter smaller than that of the first bore 11*a* extends toward a closed side of the lid 10E.

A horizontal part 11*e* formed of a translucent material is disposed at a lower end of the second bore 11*b* which place corresponds to a top portion in a usual lid. The horizontal part 11*e* may be constituted by a light converging lens or a light diverging lens, and preferably matches with the color of the main body 4A, the liquid W, or others.

A light emitter 20 is disposed near a radial and an axial center of the second bore 11*b*.

The light emitter 20 is preferably a light emitting diode, from which two conducting wires extend to be connected to a button battery fixed on a wall surface of the second bore 11*b*, although not shown. The color of the light emitted from the light emitter 20 may be any, but preferably matches the main body 4A, the horizontal part 11*e*, and stickers M1, M2, . . . as described later.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

On a cylindrical part 4Aa of the main body 4A, a plurality of stickers M1, M2, . . . are attached at appropriate places. The stickers M1, M2, . . . have a property of reflecting light, and may have any color and shape.

A saucer-like base member 25 is removably attached to an under side of the main body 4A. A bottom surface of the base member 25 includes a light reflecting surface 26 constituted by a mirror surface or a fluorescent surface that has a property of reflecting light. The light reflecting surface 26 may constitute an entirety or a part of the bottom surface, and may be provided by a surface where an image, such as that of a character or a name of an owner, is presented.

An operation of the thus constructed bottle-like container 3E will be described, with reference to FIG. 6.

With the main body 4A accommodating the liquid W such as juice to a liquid level L, the light emitter 20 as disposed in the bore 11*b* of the lid 10E emits light. The light is transmitted through the horizontal part 11*e* to enter the main body 4A.

As indicated by arrows in FIG. 6, a part of the light having entered the main body 4A is reflected by the liquid surface L, thereby enabling recognition of an amount of the liquid remaining, another part of the light having entered the main body 4A is incident on the stickers M1, M2, . . . , thereby making images of the stickers show up, and still another part of the light having entered the main body 4A is incident on the bottom surface of the base member 25, thereby reflecting the image of the character, the name, or others on the light reflecting surface 26 that may be the entirety or a part of the bottom surface of the base member 25.

The other part of the operation of the container according to the sixth embodiment, including that the container has the function of the accessory of light, is substantially the same as the operation of the container according to the above-described embodiments.

Figure 7:
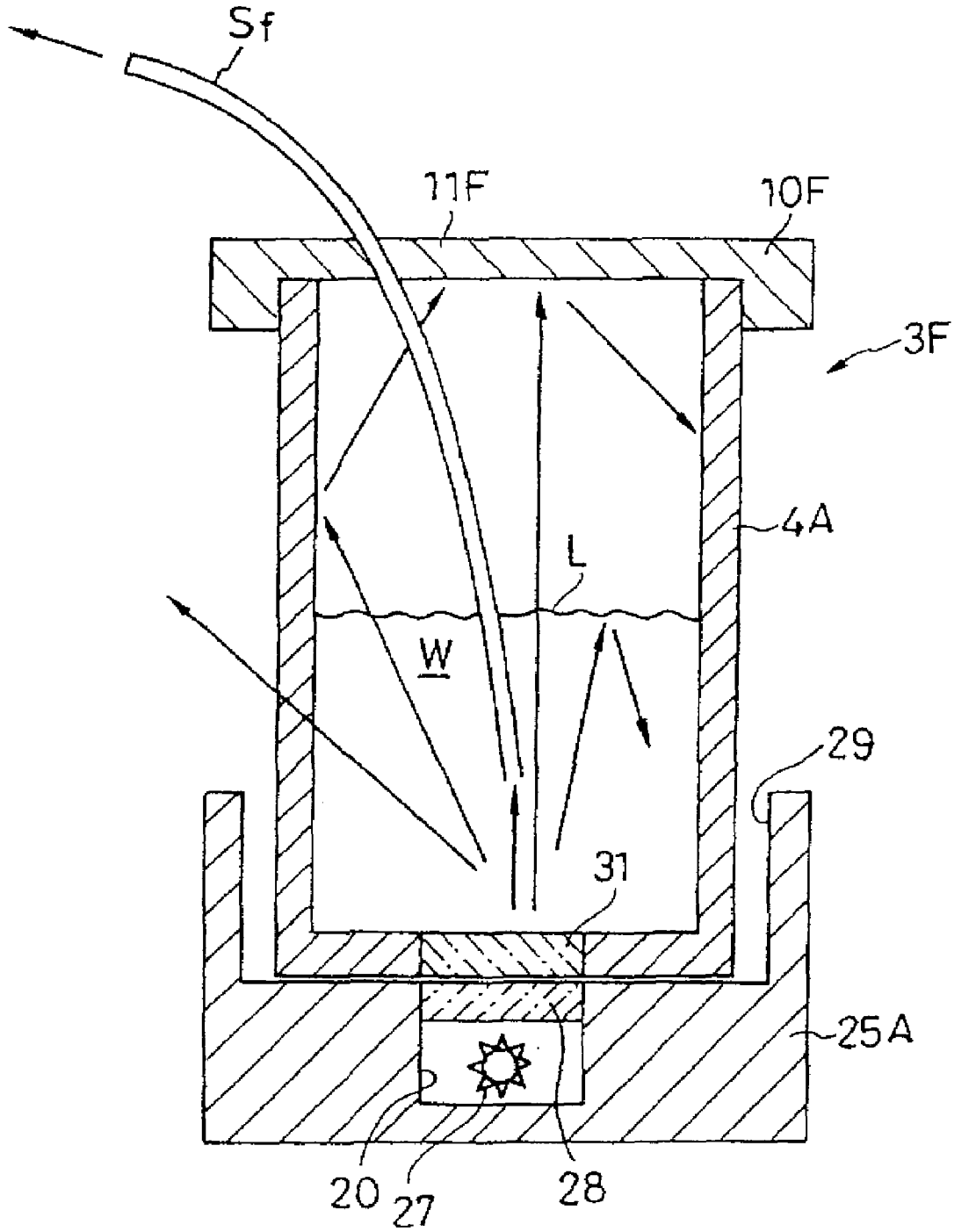
FIG. 7 is a cross-sectional view of an overall structure and an operation of a bottle-like container according to a seventh embodiment of the invention.

FIG. 7 is a cross-sectional view of an overall structure and an operation of a bottle-like container according to a seventh embodiment of the invention, as improved over the conventional containers.

A container 3F according to the sixth embodiment includes a bottle-like main body 4A which is formed of a translucent material and in which a liquid beverage W such as juice is accommodated, and a lid 10F that is fastened to an upper portion of the main body 4A by being screwed thereon. The fastening may not be made by the screwing, but may be made by fitting.

A drinking straw Sf, through which an optical fiber is inserted, is removably attached to a top portion 11F of the lid 10F. A first horizontal part 31 of a translucent material having a translucency higher than that of the main body 4A is disposed in a bottom wall of the main body 4A formed of a translucent material.

A saucer-like base member 25A is removably attached to an under side of the main body 4A. A recess 27 is formed at a position corresponding to the first horizontal part 31 in a bottom surface of the base member 25A.

A second horizontal part 28 having a transparency equal to that of the first horizontal part 31 is disposed over the recess 27.

Each of the first and second horizontal parts 31, 28 may be constituted by a light converging lens or a light diverging lens, and preferably matches with the color of the main body 4A, the liquid W, or others.

A light emitter 20 is disposed near a radial and an axial center of a space defined in the recess 27.

The light emitter 20 is preferably a light emitting diode, from which two conducting wires extend to be connected to a button battery fixed on a wall surface of the recess 27, although not shown. The color of the light emitted from the light emitter 20 may be any, but preferably matches the main body 4A, the first and second horizontal parts 31, 28, and others.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

An operation of the thus constructed bottle-like container 3F will be described, with reference to FIG. 7.

With the main body 4A accommodating the liquid W such as juice to a liquid level L, the light emitter 20 as disposed in the recess 27 of the base member 25A emits light. The light is transmitted through the first and second horizontal parts 28, 31 to enter the main body 4A.

As indicated by arrows in FIG. 7, the light having entered the main body 4A is reflected by the liquid surface L to enable recognition of the liquid remaining, and also transmitted through, and reflected by, a side wall of the main body 4A to be attenuated and radiated to the exterior through various paths.

Further, a part of the light having entered the main body 4A is radiated to the exterior through the straw Sf in which the optical fiber is inserted.

The other part of the operation of the container according to the seventh embodiment, including that the container has the function of the accessory of light, is substantially the same as the operation of the container according to the above-described embodiments.

Figure 8:
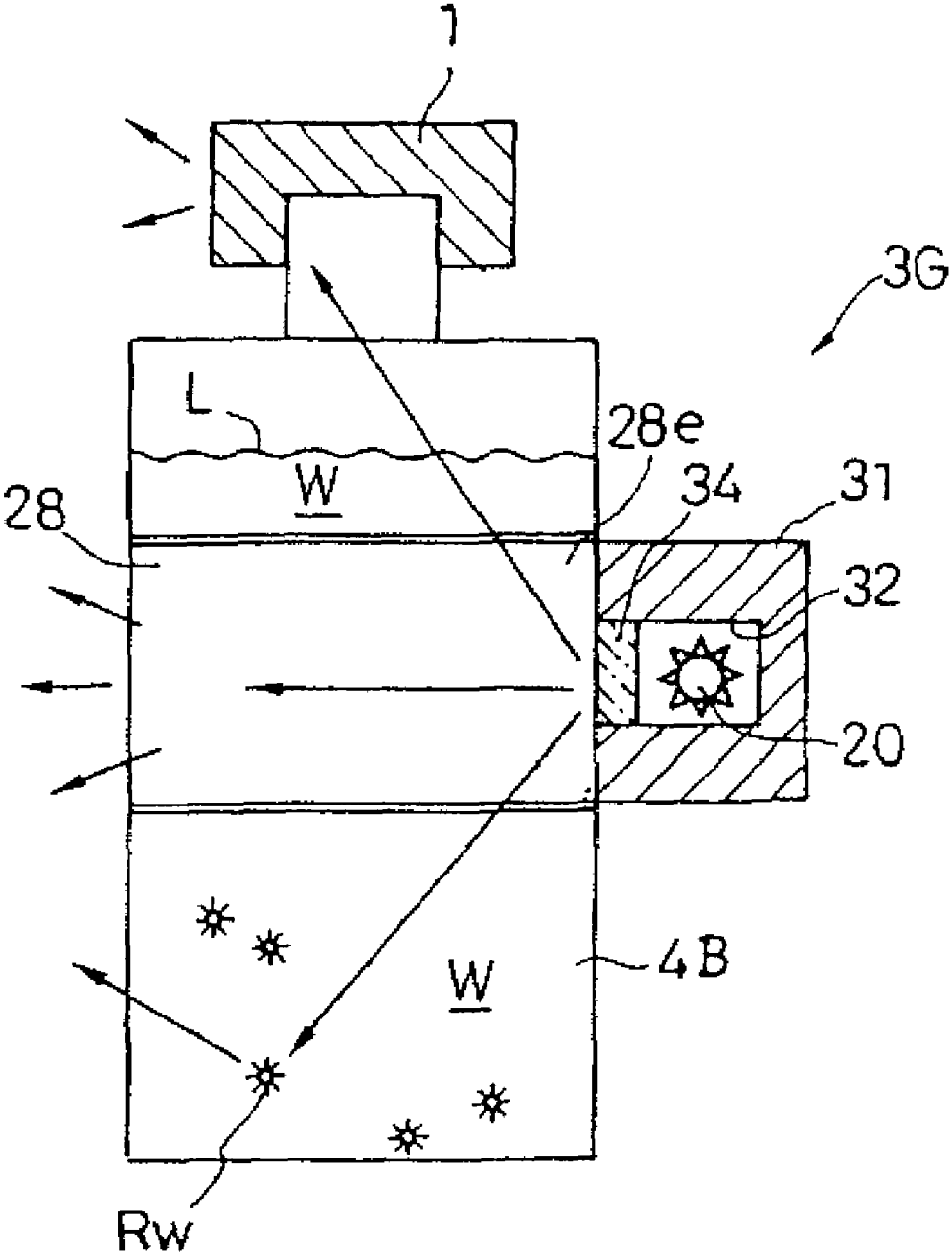
FIG. 8 is a cross-sectional view of an overall structure and an operation of a bottle-like container according to an eighth embodiment of the invention.

FIG. 8 is a cross-sectional view of an overall structure and an operation of a bottle-like container according to an eighth embodiment of the invention, as improved over the conventional containers.

A container 3G according to the eighth embodiment includes a bottle-like main body 4B which is formed of a translucent material and in which a liquid beverage W such as juice is accommodated, and a lid 1 that is fastened to an upper portion of the main body 4B by being screwed thereon.

A light reflecting material Rw harmless to human being and animals, such as gold foil chips, is mixed in the liquid W.

A cylindrical body 28 formed of a translucent material to have a color is attached inside the main body 4B such that the cylindrical body 28 extends perpendicularly to an axis of the main body 4B.

A cylindrical member 31 with a closed end is attached to an end 28*e* of the cylindrical body 28 such that the cylindrical member 31 and the cylindrical body 28 are substantially coaxial. A polarizing plate 34 having a polarizing property is attached at an end portion of the cylindrical member 31 on the side of the cylindrical body 28.

A light emitter 20 is disposed at a radial and an axial center of an inner bore 32 of the cylindrical member 31.

The light emitter 20 is preferably a light emitting diode, from which two conducting wires extend to be connected to a button battery fixed on a wall defining the inner bore 32, although not shown. The color of the light emitted from the light emitter 20 may be any, but preferably matches the main body 4B, the polarizing plate 34, and others.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

An operation of the thus constructed bottle-like container 3G will be described, with reference to FIG. 8.

With the main body 4B accommodating to a liquid level L the liquid W such as juice, in which the light reflecting material Rw such as gold foil chips is mixed, the light emitter 20 as disposed in the inner bore 32 of the cylindrical member 31 emits light. The light is transmitted through the polarizing plate 34 to enter the cylindrical body 28.

A part of the light having entered the cylindrical body 28 travels straight therein to be radiated to the exterior of the main body 4B, and another part of the light having entered the cylindrical body 28 is transmitted through a wall of the cylindrical body 28 and the liquid W to be reflected by the liquid surface L and radiated to the exterior, thereby enabling recognition of an amount of the liquid remaining. Further, the light transmitted through the wall of the cylindrical body 28 and the liquid W is also reflected by the reflecting material Rw mixed in the liquid W such as gold foil chips, thereby radiating brilliant light to the exterior.

Still another part of the light having entered the cylindrical body 28 is transmitted through the lid 1 formed of a translucent material, and then radiated to the exterior.

Thus, the light emitted from the light emitter 20 is radiated to the exterior via various paths and in various rays of reflected light.

The other part of the operation of the container according to the eighth embodiment, including that the container has the function of the accessory of light, is substantially the same as the operation of the container according to the above-described embodiments.

Figure 9:
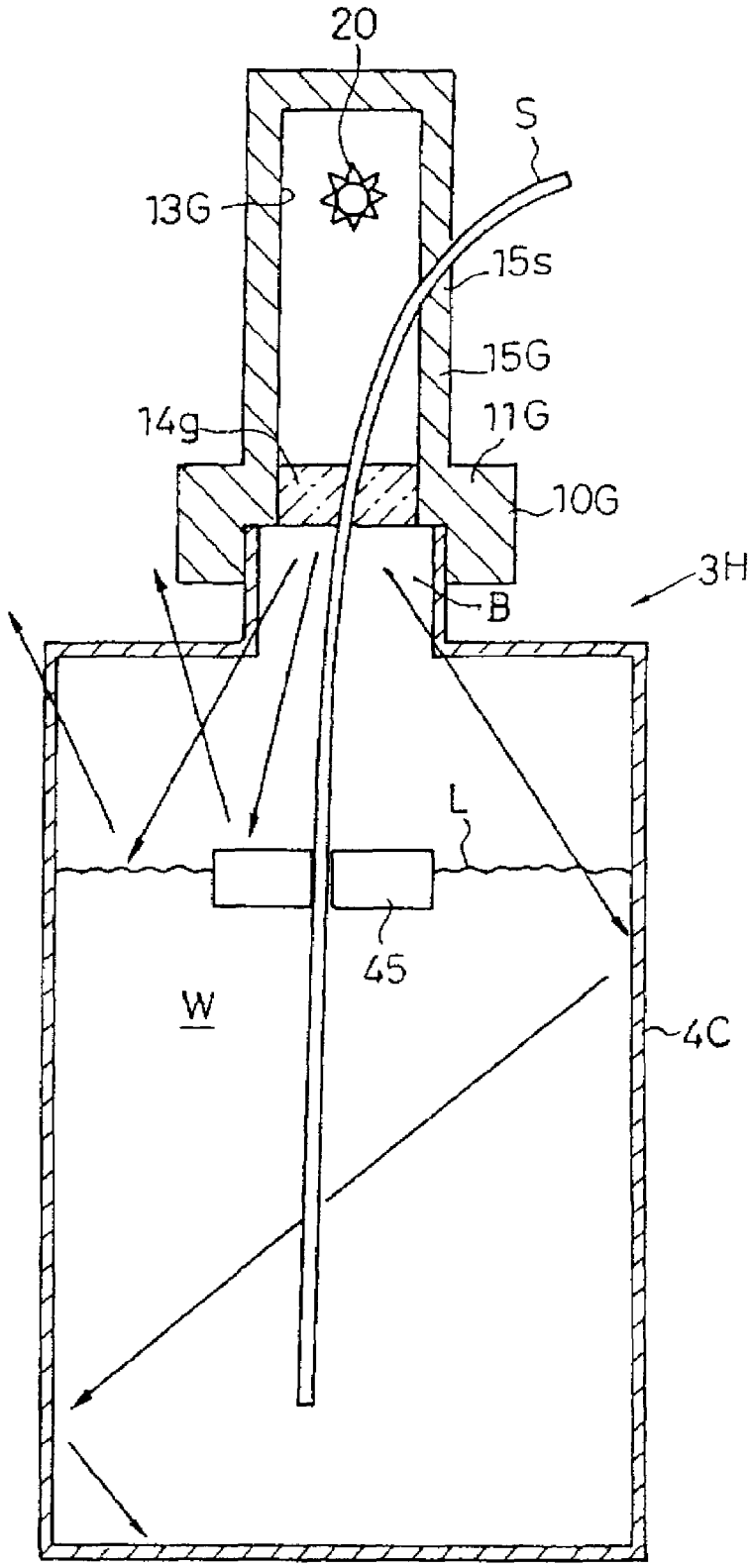
FIG. 9 is a cross-sectional view of an overall structure and an operation of a bottle-like container according to a ninth embodiment of the invention.

FIG. 9 is a cross-sectional view of an overall structure and an operation of a bottle-like container according to a ninth embodiment of the invention, as improved over the conventional containers.

A container 3H according to the ninth embodiment includes a bottle-like main body 4C which is formed of a translucent material and in which a liquid beverage W such as juice is accommodated, and a lid 10G that is fastened to an upper portion of the main body 4C by being screwed thereon. The fastening may not be made by the screwing, but may be made by fitting.

The lid 10G has a top portion 11G that corresponds to an upper end in a usual lid, and a cylindrical part 15G extending upward is disposed on the top portion 11G.

A horizontal part 14*g* formed of a translucent material is attached at a lower end of an inner bore 13G of the cylindrical part 15G and at a vertical position the same as that of the top portion 11G.

A light transmitter 20 is disposed in an upper portion of the inner bore 13G of the cylindrical part 15 at a radial position near an axis of the inner bore 13G such that the light transmitter 20 does not interfere with a drinking straw S as described later.

The light emitter 20 is preferably a light emitting diode, from which two conducting wires extend to be connected to a button battery fixed on a wall defining the inner bore 13G, although not shown. The color of the light emitted from the light emitter 20 may be any, but preferably matches the main body 3H, the horizontal part 14*g*, a float 45 described later, and others.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

The straw S is attached to extend from the exterior of the cylindrical part 15G to the inside of the main body 4C, through a side wall of the cylindrical part 15G and the horizontal part 14*g*. The straw S is loosely fitted in the float 45 formed of a material reflecting light or a fluorescent material in a donut-like shape, and thus vertically moves with the varying level of a liquid surface L.

An operation of the thus constructed bottle-like container 3H will be described, with reference to FIG. 9.

With the main body 4C accommodating the liquid W such as juice to the liquid level L, the light emitter 20 as disposed in the inner bore 13G of the cylindrical part 15G emits light. The light is transmitted through the horizontal part 14*g* to enter the main body 4C.

The light from the light emitter 20 and having entered the main body 4C is reflected by the liquid surface L that varies as the liquid W is sucked through the straw S, and the float 45. The reflected light from the shifting liquid surface is radiated to the exterior of the main body 4C, and cooperates with the reflected light from the float 45 to enable recognition of the liquid level L from the exterior. In particular, in a place dim or dark, the liquid level is easily recognizable.

The light is also reflected by a wall of the main body 4C, so that reflected light is radiated from an entirety of the main body 4C.

The other part of the operation of the container according to the ninth embodiment, including that the container has the function of the accessory of light, is substantially the same as the operation of the container according to the above-described embodiments.

Figure 10:
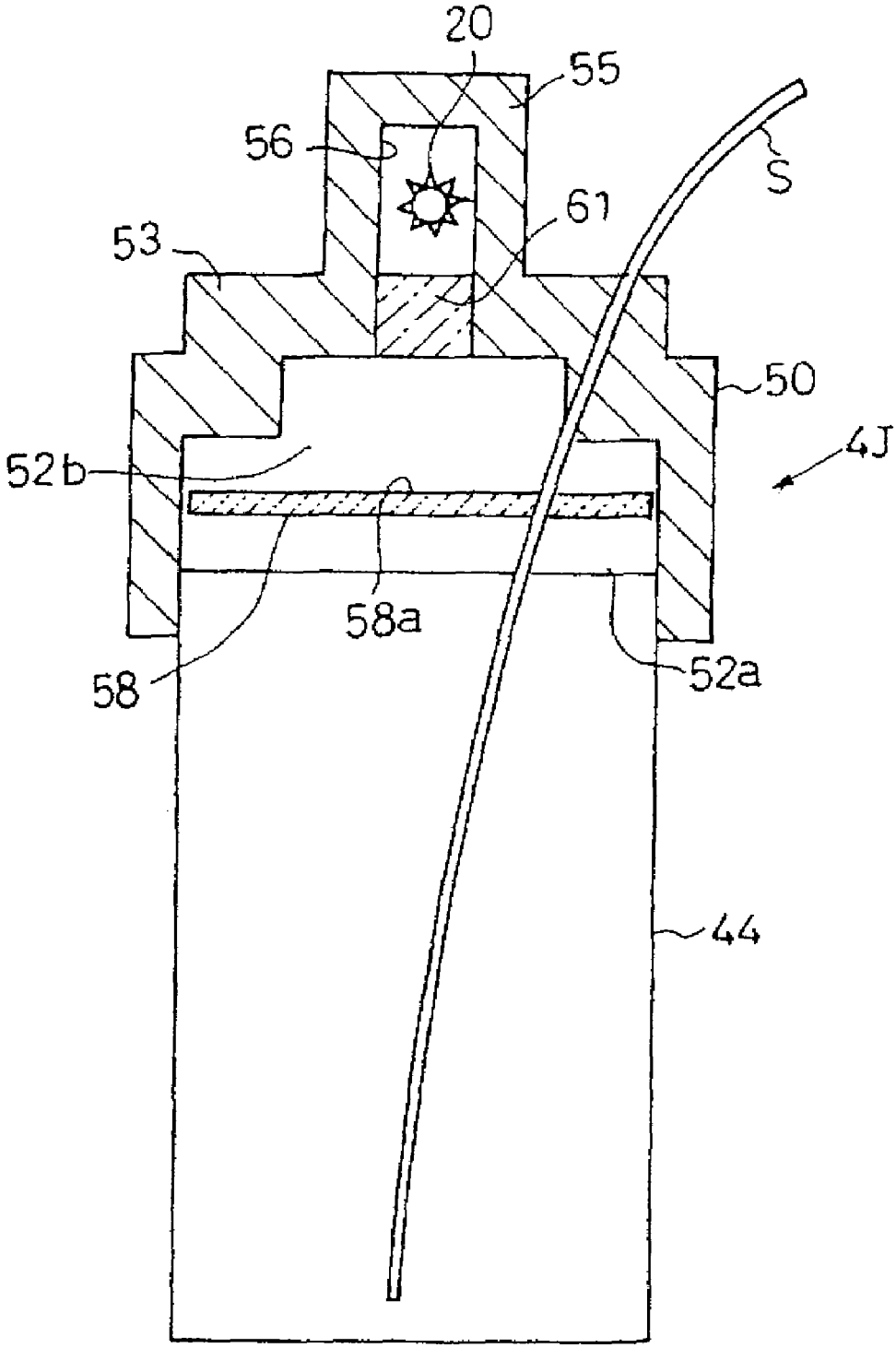
FIG. 10 is a cross-sectional view of an overall structure of a can-like container according to a tenth embodiment of the invention.

FIG. 10 is a cross-sectional view of an overall structure of a can-like container according to a tenth embodiment of the invention, as improved over the conventional containers.

A container 4J according to the tenth embodiment includes a can portion or a main body 44 which is formed of an opaque material such as iron, aluminum, or paper, and in which a liquid beverage W such as juice, and a lid 50 removably fitted on an upper portion of the main body 44.

The lid 50 is formed of a translucent material, and has at its lower portion a first bore 52*a* having a diameter conforming to an external diameter of the upper portion of the main body 44 on which the lid 50 is fitted. The lid 50 further has a second bore 52*b* and a third bore 56.

The second bore 52*b* is connected to an end of the first bore 52*a*, and has a diameter smaller than that of the first bore 52*a*. The third bore 56 is connected to an end of the second bore 52*b* via a horizontal part 61 formed of a translucent material, such that light can travel across the horizontal part 61. A diameter of the third bore 56 is smaller than that of the second bore 52*b*.

A light emitter 20 is disposed in the third bore 56 at a radial and an axial center thereof.

The light emitter 20 is preferably a light emitting diode, from which two conducting wires extend to be connected to a button battery fixed on a wall defining the third bore 56, although not shown. The color of the light emitted from the light emitter 20 may be any, but preferably matches the horizontal member 61, a plate 58 described later, a color of the main body 44, and others.

The light emitter 20 may not be the light emitting diode, but may be constituted by a fluorite or a fluorescent member that is inferior to a light emitting diode in light emission output but does not require a power source.

The capacity of the button battery is determined by taking account of a time period during which light is to be emitted. However, since usually the power consumed by the light emitting diode is extremely small, a button battery whose capacity is the smallest among commercially available button batteries suffices. The power source of the light emitting diode or the light emitter 20 in other forms is not limited to a button battery. For instance, the power source may be a common dry battery, where there is a sufficient attaching space.

The horizontal part 61 may be constituted by a light converging lens or a light diverging lens, and may be colored.

An image 58*a* such as that of a character is painted on the plate 58 with a fluorescent paint.

A drinking straw S is attached to extend from the exterior of the container 4J to the inside of the main body 44 through the second and first bores 52*b*, 52*a* inside the lid 50 and the plate 58.

An operation of the thus constructed can-like container 4J will be described, with reference to FIG. 10.

The light emitter 20 as disposed in the third bore 56 of the lid 50 emits light. The light is transmitted through the horizontal part 61 to enter the second and first bores 52*b*, 52*a*.

The light from the light emitter 20 as having entered into the second and first bores 52*b*, 52*a* is reflected by the plate 58 to reflect the image 58*a* such as that of a character, and radiated to the exterior from the lid 50. Thus, the presence or location of the main body 44 and the straw S can be recognized in the darkness.

The lid 50 thus emitting and reflecting light and attached to the main body 44 enables easy recognition of the presence or location of the main body 44 and the straw S in the darkness.

The other part of the operation of the container according to the tenth embodiment, including that the container has the function of the accessory of light, and that the lid 50 can be reused by attaching to another main body 44, is substantially the same as the operation of the container according to the above-described embodiments.

DESCRIPTION OF REFERENCE NUMERALS

W liquid beverage, juice
3 container
4 main body
10 lid
11 top portion
12 first cylindrical part
13 inner bore
14 first horizontal part
15 second cylindrical part
16 inner bore
18 second horizontal part
20 light emitter

What is claimed is:

1. A bottle-like container, comprising:

a main body formed of a translucent material and having a neck portion in which an opening is formed;

a lid removably obstructing said opening of said main body, said lid having:

a top portion; and a first horizontal part formed of a translucent material and attached to the top portion; and a cylindrical member in a cap-like shape which surrounds the lid and inside of which an inner bore is defined, the cylindrical member having:

a second horizontal part formed of a translucent material and attached in the inner bore of the cylindrical member; and a light emitter disposed between the second horizontal part and a top portion of the cylindrical member, wherein said cylindrical member surrounds said lid such that a clearance is provided between said cylindrical member and said lid, so that said cylindrical member is easily removable and attachable with respect to said lid, wherein a liquid is storable in a chamber defined by said main body and said lid, wherein when the said lid obstructs the opening of said main body, said lid is positioned outside of said neck portion in the radial direction, so as to surround said neck portion, and wherein said light emitter is a light emitting diode (LED) from which two conducting wires extend to a button battery in the inner bore of the cylindrical member.

* * * * *